United States Patent [19]

Tershak et al.

[11] Patent Number: 4,481,785

[45] Date of Patent: Nov. 13, 1984

[54] ADAPTIVE DEFROST CONTROL SYSTEM FOR A REFRIGERATOR

[75] Inventors: Andrew T. Tershak, Center Township, Vanderburgh County, Ind.; Michael D. Thieneman, Lincoln Township, Berrien County, Mich.

[73] Assignee: Whirlpool Corporation, Benton Harbor, Mich.

[21] Appl. No.: 402,469

[22] Filed: Jul. 28, 1982

[51] Int. Cl.[3] ..... F25D 21/06

[52] U.S. Cl. ..... 62/153; 62/155; 62/156

[58] Field of Search ..... 62/153, 154, 155, 156, 62/234

[56] References Cited

U.S. PATENT DOCUMENTS

| | | | |
|---|---|---|---|
| 2,725,196 | 11/1955 | Trittschuh | 236/44 |
| 3,460,352 | 8/1969 | Lorenz | 62/153 |
| 3,518,841 | 7/1970 | West, Jr. | 62/153 |
| 3,548,609 | 12/1970 | Kusuda et al. | 62/156 |
| 3,759,049 | 9/1973 | Bell et al. | 62/80 |
| 4,156,350 | 5/1979 | Elliott et al. | 62/80 |
| 4,173,871 | 11/1979 | Brooks | 62/155 X |
| 4,227,411 | 10/1980 | Abramovich | 73/336.5 |
| 4,251,988 | 2/1981 | Allard et al. | 62/80 |
| 4,297,852 | 11/1981 | Brooks | 62/153 |
| 4,327,557 | 5/1982 | Clarke et al. | 62/153 |
| 4,328,680 | 5/1982 | Stamp, Jr. et al. | 62/155 |

*Primary Examiner*—Harry B. Tanner

*Attorney, Agent, or Firm*—Wood, Dalton, Phillips, Mason & Rowe

[57] ABSTRACT

An adaptive demand defrost control system controls the length of an interval between defrost operations in accordance with the number and duration of compartment door-openings, the duration of a previous defrost operation as corrected by the temperature of the evaporator prior to defrost, and the length of time the compressor has been energized. A count is stored which is varied according to a decrementing schedule, with the decrementing schedule in turn being based upon a comparison of the corrected defrost duration with either a desired defrost duration or a range of desired defrost durations. A defrost operation is initiated when the count reaches a predetermined value. An alternative embodiment of the invention develops an indication of the ambient humidity and controls humidity-dependent apparatus in accordance with the indication.

18 Claims, 10 Drawing Figures

110
V1
V1
84
V2
K1a
R5
R7
K2
40
C3
C4
R6
K2a
42
V2
K4a
111
112
54
K1
K4
V2
K3
K3a
V1
82
V1
V1
50
38
COM.
A/D
52
100
102
104
5 V REG.
V1
106
46b
R4
V1
R3
D2
C2
V1
R2
44b
R1
D1
C1

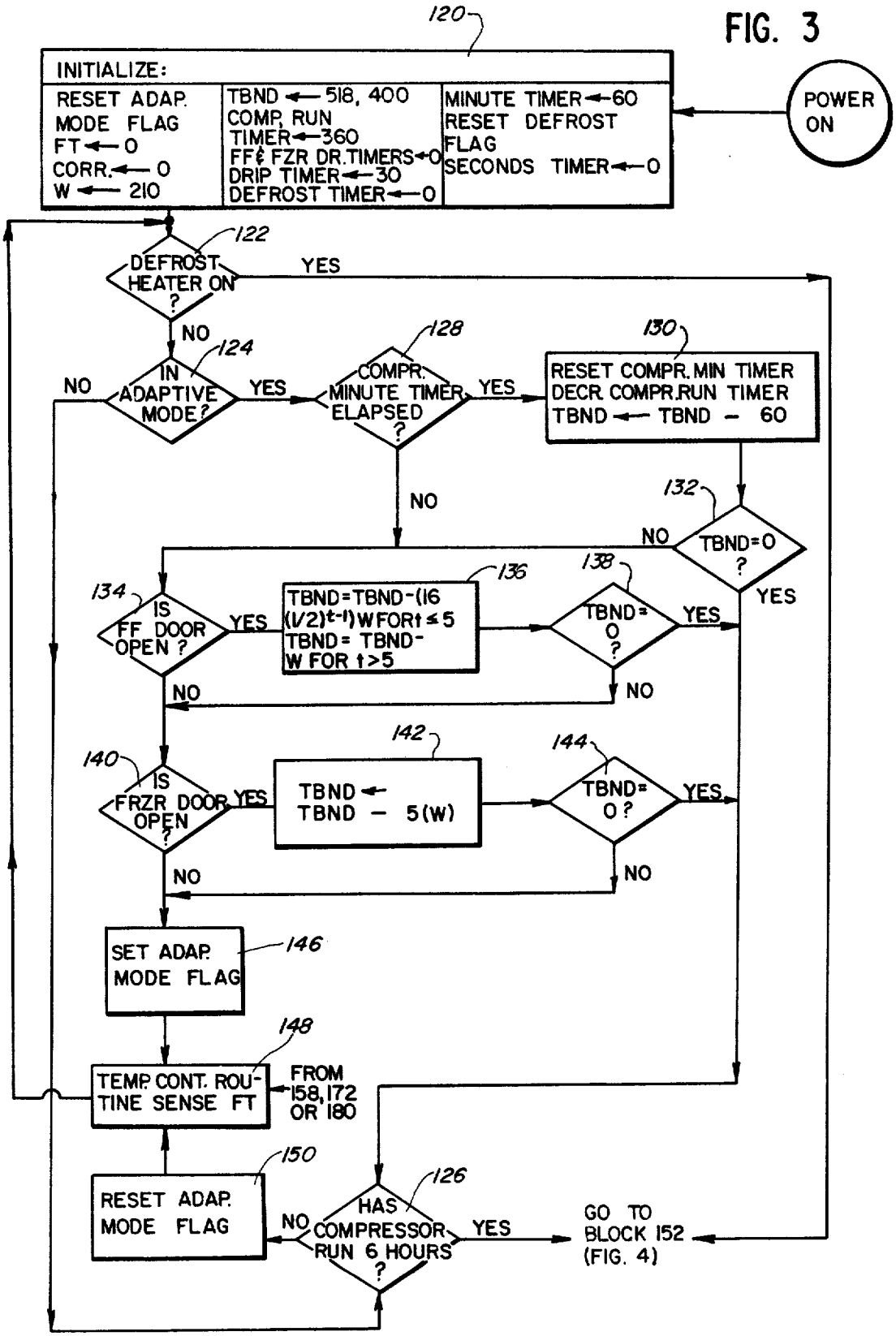
FIG. 3
120
INITIALIZE:
RESET ADAP. MODE FLAG
FT ← 0
CORR. ← 0
W ← 210
TBND ← 518, 400
COMP. RUN TIMER ← 360
FF & FZR DR. TIMERS ← 0
DRIP TIMER ← 30
DEFROST TIMER ← 0
MINUTE TIMER ← 60
RESET DEFROST FLAG
SECONDS TIMER ← 0
POWER ON
122
DEFROST HEATER ON ?
YES
NO
124
IN ADAPTIVE MODE?
NO
YES
128
COMPR. MINUTE TIMER ELAPSED ?
YES
NO
130
RESET COMPR. MIN TIMER
DECR. COMPR. RUN TIMER
TBND ← TBND − 60
132
TBND=0 ?
NO
YES
134
IS FF DOOR OPEN ?
YES
NO
136
TBND=TBND-(16 (1/2)^(t-1) W FOR t ≤ 5
TBND = TBND- W FOR t>5
138
TBND= 0 ?
YES
NO
140
IS FRZR DOOR OPEN ?
YES
NO
142
TBND ← TBND − 5(W)
144
TBND= 0 ?
YES
NO
146
SET ADAP. MODE FLAG
148
TEMP. CONT. ROUTINE SENSE FT
FROM 158, 172 OR 180
150
RESET ADAP. MODE FLAG
126
HAS COMPRESSOR RUN 6 HOURS ?
NO
YES
GO TO BLOCK 152 (FIG. 4)

DOOR WEIGHTING FUNCTIONS

ADAPTIVE DEFROST CONTROL SYSTEM FOR A REFRIGERATOR

BACKGROUND OF THE INVENTION

This invention relates to defrost controls for a refrigerator, and more particularly, to an adaptive demand defrost control system which provides a variable interval between defrost operations which is based upon several factors, including the amount and duration of door openings and the length of previous defrost operations.

In general, in a refrigerator it is desirable to defrost only as often as is necessary to maintain an efficient cooling system. This objective dictates that a balance be struck between the competing considerations of system operation with a frosted evaporator, the energy consumed in removing a frost load from the evaporator and the acceptable level of temperature fluctuation within the refrigerated compartments caused by a defrosting operation.

A successful attempt at meeting this objective is shown and described in U.S. patent application Ser. No. 155,154, now U.S. Pat. No. 4,327,557, filed May 30, 1980, entitled "Adaptive Defrost Control System" and assigned to the assignee of this application. The system disclosed therein takes into account the number and duration of freezer and fresh food door compartment openings, the duration of the previous defrosting operation, and the total accumulated compressor run time since the previous defrost operation. In general, defrosting is provided at variable intervals as determined by a weighted accumulation of the number and duration of freezer and fresh food door openings, with the weighting functions being adaptably controlled as a function of the time required to perform the previous defrost operation.

The control disclosed in the above application stores a count which is decremented by the weighting functions during a door-open interval. The count is decremented at a first constant rate during a first predetermined period of time that the fresh food door is open, and is decremented at a second constant rate thereafter. The count is decremented at a third constant rate during an initial predetermined period of time that the freezer door is open, and a fourth constant rate thereafter.

The rates of decrementing the count are determined by comparing the measured length of a defrosting operation against a desired defrost length. In many instances, the comparison of the measured defrost length with the desired defrost length operates to change the length of the interval before the next defrost operation, in turn forcing the next succeeding defrost length toward the desired value.

While the defrost control described above has been successful in implementing efficient control of a defrost heater, it has been found that efficiency can be further increased if, in addition to the factors utilized by the above described defrost control, the evaporator temperature is considered as a factor in determining the length of a defrost interval.

Generally, it has been found that there is little or no correlation between the duration of a defrost operation and the amount of frost which has actually been removed from the evaporator during the defrost operation. This is due to the fact that the measured length of a defrost operation is not only dependent upon the amount of frost on the evaporator coil, but is also strongly dependent upon the temperature of the evaporator at the time the defrost operation is initiated. Since the defrost control disclosed in the above-mentioned patent utilizes the length of a defrost operation as a factor in determining the duration of the next defrost interval, the defrost control may provide less-than-optimal defrost operation if the temperature of the evaporator is not considered.

Moreover, it has been found that the decrementing of the count at constant rates during the time the fresh food door is open does not result in an entirely accurate representation of the amount of frost which has formed on the evaporator due to the moisture introduced into the refrigerator while the door is open. Again, this may result in a less-than-optimal defrost interval.

Furthermore, it has been found desirable to incorporate control of a humidity-dependent apparatus, such as an anti-sweat heater, in accordance with the ambient humidity to which the refrigerator is exposed. Reliable humidity sensors are, however, relatively expensive and impractical for use on household refrigerators and the like.

SUMMARY OF THE INVENTION

In accordance with the present invention, a defrost control system for a refrigerator provides a defrost operation at the end of a variable interval referred to as a defrost interval, that is a function of the number and duration of compartment door openings using an adaptive control scheme that is dependent upon the measured length of the previous defrost operation, as corrected by a measure of the evaporator temperature prior to the initiation of the defrost operation.

In many refrigerators air is discharged from an evaporator directly into a freezer compartment, and the temperature within the freezer compartment therefore provides an accurate indication of the relative temperature of the evaporator. In such refrigerators, the measured defrost length can be corrected as a function of the measured temperature of the freezer compartment, rather than the measured temperature of the evaporator. This eliminates the need for a separate temperature sensor connected directly to the evaporator, and a single sensor can be used to measure the freezer temperature and provide a relative measure of the evaporator temperature.

In the illustrated embodiment of the invention, a count is stored representing the interval before which a defrost is initiated. The count is varied according to a decrementing schedule which varies as a function of time. Specifically, the decrementing schedule is arranged such that the count is varied by different amounts for each second of a predetermined interval that the fresh food door is open. Following the predetermined interval, the count is varied at a first constant rate. For each second that the freezer door is open, the count is varied at a second constant rate which is greater than the first constant rate. In particular, the count is decremented by an integer multiple of a factor W, with the integer factor being a function of the door which is opened, and in the case of the fresh food door, the length of time the door is open.

Once the count has been varied to a predetermined value, a defrost operation is initiated. It has been found that the decrementing schedule noted above allows for a close approximation of the manner in which frost actually builds up on the evaporator in response to door openings. Consequently, the correlation between the defrost interval and the actual frost load on the evaporator is improved and, hence, refrigerator operation efficiency is enhanced.

The factor W is calculated in accordance with a comparison of the measured defrost length with a desired defrost length, the measured defrost length being corrected as a function of the measured freezer temperature prior to the defrost operation. It has been found that correcting the measured defrost length in this manner is particularly important in providing a high degree of correlation between the defrost length and the amount of frost actually removed from the evaporator coils during the defrost operation. Consequently, this corrected defrost duration allows the factor W to be calculated in such a way that the defrost operations are initiated in an efficient manner.

A first alternative embodiment of the defrost control operates to compare the measured defrost length against an optimum defrost length which is varied as a function of the measured freezer temperature during a defrost interval. It will be appreciated that because of the variations which are usually encountered in refrigerator components, there is a range of optimum defrost lengths rather than one particular desired defrost length. The control operates to vary the decrementing factor W when the actual defrost length is outside a predetermined range of values surrounding the optimum defrost length, with no change being made to W if the measured length is within the range of optimum defrost length values.

A second alternative embodiment of the invention develops an indication of the ambient humidity within which the refrigerator is operating. A humidity factor is calculated which is a function of the amount of frost formed on the evaporator, as indicated by the length of a defrost operation, and the usage encountered by the refrigerator, as indicated by the length of time that the refrigerator doors have been open. If the humidity factor exceeds a predetermined maximum, then a humidity-dependent device, such as an anti-sweat heater, may be energized to reduce the condensation of moisture on the exterior of the refrigerator. In this way, a reliable indication of humidity is obtained without the need for expensive humidity-sensing apparatus.

BRIEF DESCRIPTION OF THE DRAWING

FIGS. 3 and 4 together comprise a flow chart of the control program contained in the control logic;

DESCRIPTION OF THE PREFERRED EMBODIMENT

Figure 1:
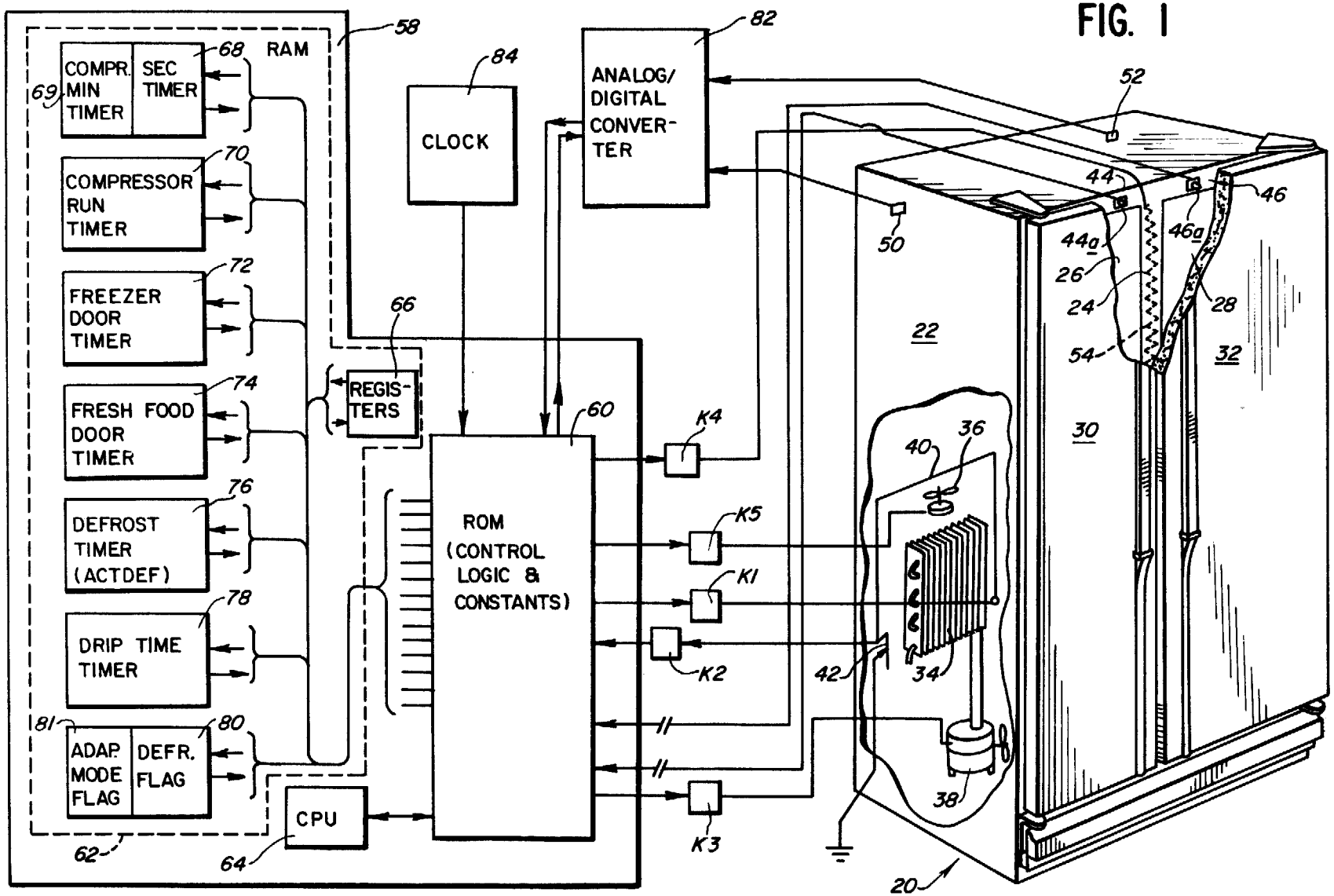
FIG. 1 is a perspective view of a refrigerator, with a portion of the sidewall broken away to reveal the components therein, in conjunction with apparatus for implementing the defrost control of the present invention.

Referring now to FIG. 1, there is illustrated a conventional refrigerator 20 in conjunction with a block diagram of the defrost control system of the present invention. The refrigerator 20 includes a cabinet 22 which in turn includes an internal compartment separator 24 separating a freezer compartment 26 from a fresh food compartment 28. A freezer door 30 seals off the freezer compartment 26 from the outside and a fresh food door 32 encloses the fresh food compartment.

The fresh food and freezer compartments are cooled by passing refrigerated air into the compartments. The air is refrigerated as a result of being passed in heat exchange relationship with a conventional evaporator 34 and is forced by an evaporator fan 36 into the refrigerated compartments 26,28. The refrigeration apparatus includes a compressor 38 and a condenser (not shown) interconnected with the evaporator 34 in a conventional manner to effect the flow of refrigerant thereto. A defrost heater 40 is positioned adjacent the coils of the evaporator 34 and is periodically energized by the defrost control of the present invention to defrost the evaporator 34. The defrost heater 40 may be a conventional resistive heater that is energized directly from an AC line by means of a relay or triac.

A conventional bimetal temperature sensor 42 is located on or adjacent the coils of the evaporator 34 so as to sense a predetermined temperature thereof. The bimetal sensor 42 operates to terminate a defrost operation in a manner to be described below.

A freezer door switch 44 having an actuator **44*a* is mounted on the cabinet 22 so that the actuator 44*a* contacts the closed freezer door 30. Similarly, a fresh food door switch 46 having an actuator 46*a* is mounted on the cabinet 22 with the actuator 46*a* in contact with the closed fresh food compartment door 32. The actuators 44*a*,46*a*, are spring-loaded so that when one of the doors 30,32 is opened, the corresponding actuator 44*a*,46*a* moves outwardly out of contact with the corresponding door 30,32 thereby causing the contacts of the switches 44,46** to close.

The freezer temperature is sensed by a freezer thermistor 50 positioned within the freezer compartment 26. A thermistor 52 is disposed within the fresh food compartment 28 to sense the temperature therein.

Disposed along the front face of compartment separator 24 is an anti-sweat or mullion heater 54 which is utilized to reduce moisture condensation, as will be described in greater detail below.

The defrost control of the present invention shown in block diagram form in FIG. 1 may be implemented by using discrete digital logic or through the use of a microcomputer. In the preferred embodiment illustrated, a single chip microcomputer 58 is used to implement the defrost control. The microcomputer integrated circuit may be a conventional, single chip device and may include on the chip, a 2048×8 bit program read-only memory, or ROM 60, and a 128 word random access memory, or RAM 62. The microcomputer 58 also includes a central processing unit, or CPU 64, which performs the various computations used in the defrost control process. The ROM 60 contains the control program, the control logic, and the constants used during control execution. The RAM 62 contains registers 66 (shown more particularly in FIG. 2A) which store the several variables used in the control program. Also included in the RAM 62 are a seconds timer 68, a compressor minute timer 69, a compressor run timer 70, a freezer door timer 72, a fresh food door timer 74, a defrost length timer 76, a drip time timer 78, a defrost flag register 80 and an adaptive mode flag register 81.

While for purposes of clarity, the RAM 62 has been illustrated as containing separate storage registers for each variable, it is to be understood that each storage register may contain the value of several variables over the course of a program execution.

In the illustrated embodiment, microcomputer 58 is implemented by using a COPS 444 microcomputer manufactured by National Semiconductor Corp., which has 21 input/output ports and serial input/output capability.

The inputs to the microcomputer 58 include the freezer door switch 44, the fresh food door switch 46, the bimetal sensor 42, and the thermistors 50,52 via an analog to digital converter 82. The state of the bimetal sensor 42 is inputted to the microcomputer 58 through a relay K2. Another input to the microcomputer 58 is from clock pulse circuitry 84 which provides a reference signal for measuring real time events, such as the length of a defrost operation.

Outputs from the microcomputer 58 are coupled to energize the defrost heater 40, the compressor 38, the mullion heater 54 and the evaporator fan 36 through relays K1, K3, K4 and K5, respectively.

The defrost control system of the present invention utilizes various data to determine when a defrost operation should be initiated. These data include the number and duration of freezer and fresh food compartment door openings, the duration of the previous defrosting operation as corrected by the temperature existing within the freezer prior to the defrost operation, and the total accumulated compressor run time since the previous defrosting operation. The number and duration of compartment door openings are detected by monitoring the door switches 44,46 associated with the two compartment doors 26 and 28. The actual duration of the defrost operation is determined by monitoring the bimetal sensor 42 and measuring the amount of time it takes from the start of the defrosting operation until the evaporator 34 reaches a predetermined temperature, as indicated by the opening of the bimetal sensor 42.

The defrost heater 40 is energized at variable intervals as determined by a weighted accumulation of the number and duration of freezer and fresh food door openings. The microcomputer 58 stores a number or count that must be decremented to zero before a defrost operation is initiated. This count, referred to as TBND (time before next defrost), is decremented by different amounts for each second of the first five seconds that the fresh food compartment door 32 is open, and is thereafter decremented at a constant rate. The count TBND is decremented by a constant amount during each second of a defrost interval that the freezer door 30 is open, regardless of the amount of time the door is open.

Figure 9:
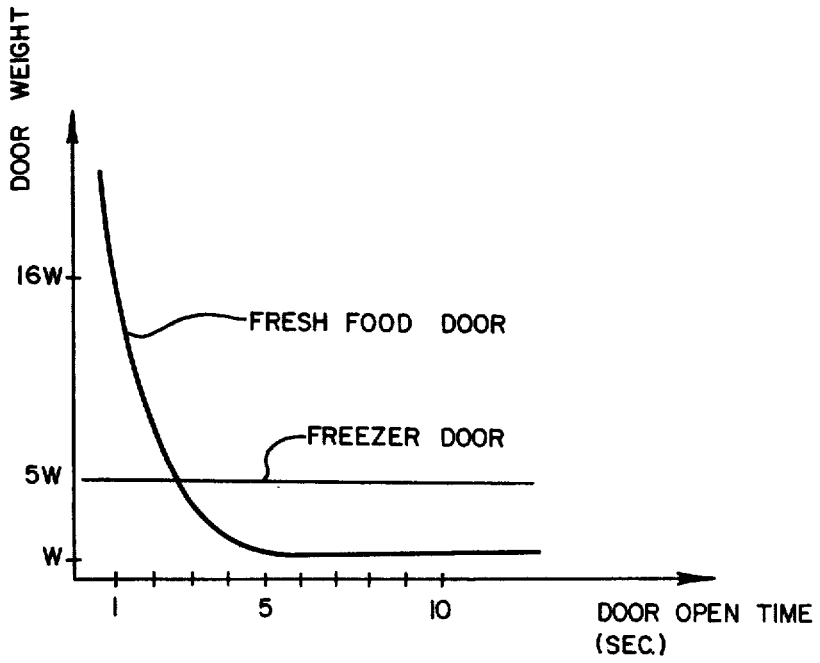
FIG. 9 is a graph representing the decrementing schedule used in the present invention.

A weighting or decrementing factor, designated W, is established and is utilized to decrement the count TBND according to the following weighting schedule, shown in graphic form in FIG. 9:

| Second of Fresh Food Door 32 Opening | Decrement TBND by |
|---|---|
| First | 16 × W |
| Second | 8 × W |
| Third | 4 × W |
| Fourth | 2 × W |
| Fifth | 1 × W |
| Each Additional | 1 × W |
| Each Second of Freezer | 5 × W |

-continued

| Second of Fresh Food Door 32 Opening | Decrement TBND by |
|---|---|
| Door 30 Opening | |

This weighting schedule is based on test data and closely approximates the manner in which frost develops on the evaporator of a conventional side-by-side refrigerator (illustrated generally in FIG. 1) in response to compartment door openings.

The count TBND is also decremented by one count for each second of compressor 38 run time.

The weighting factor W is updated, when necessary, by adding to it a correction factor, designated CORR, which is derived by adding the contents of the defrost timer 76 with a term equal to ten times the freezer temperature (in degrees Fahrenheit) occurring during the defrost interval prior to the defrost operation and by comparing this corrected defrost length with a desired defrost length designated DESDEF.

Normally, once the count TBND has been decremented to zero, the defrost heater 40 is energized. However, the compressor run time timer 70 actuates inhibiting means to prevent the initiation of a defrost operation if the count TBND reaches zero before a predetermined minimum amount of compressor run time has been accumulated. The control checks for minimum compressor run time when the count TBND is decremented to zero to determine whether the defrost indication is due to abnormal condition, such as an excessive number of door openings during a defrost interval. Under this condition, the adaptive portion of the control technique is disabled to prevent the control from adaptively varying the decrementing factor W.

A first alternative embodiment of the invention compares the actual defrost length against a range of values surrounding the optimal defrost length and varies the weighting factor W in accordance therewith. The optimal defrost length against which the measured defrost length is compared is varied as a function of the measured freezer temperature during defrost, thereby varying, under the same circumstances, the newly derived door weighting function and, hence, varying the rate at which the count is decremented during the next defrost interval. In effect, the temperature within the freezer compartment 26 prior to a defrost operation is considered in determining the weighting factor W and, hence, the next defrost interval.

A second alternative embodiment of the invention considers door-open information as well as the duration of a defrost operation to develop a measure of the ambient humidity in which the refrigerator 20 is operated. This measure of ambient humidity is used to control anti-sweat heaters associated with the refrigerator cabinet, such as the mullion heater 54, to reduce the amount of condensation occurring on the cabinet.

Figure 2A:
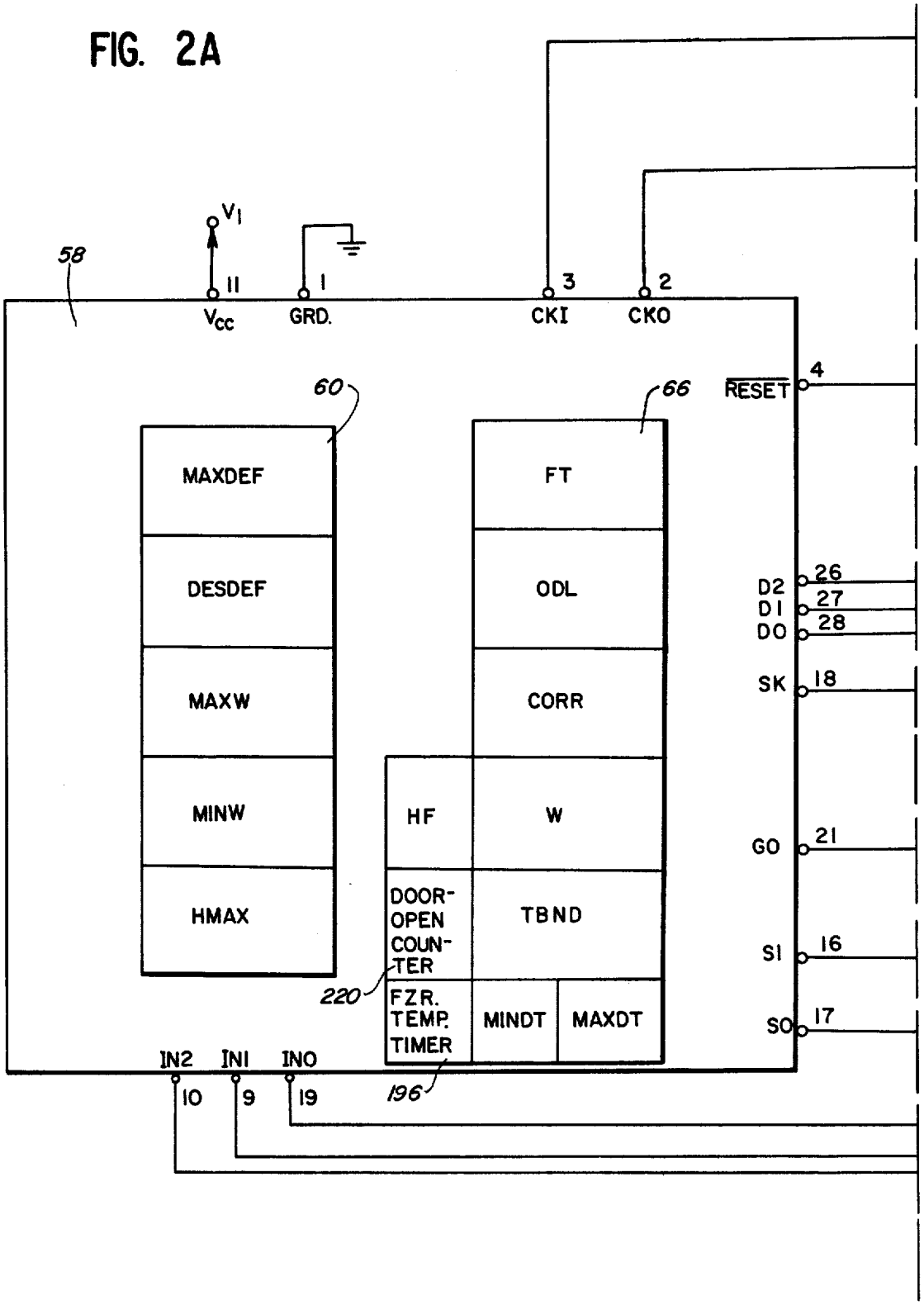
FIGS. 2A and 2B, when jointed along the dashed lines, comprise a single schematic diagram of the defrost control shown in block diagram form in FIG. 1.
Figure 2B:
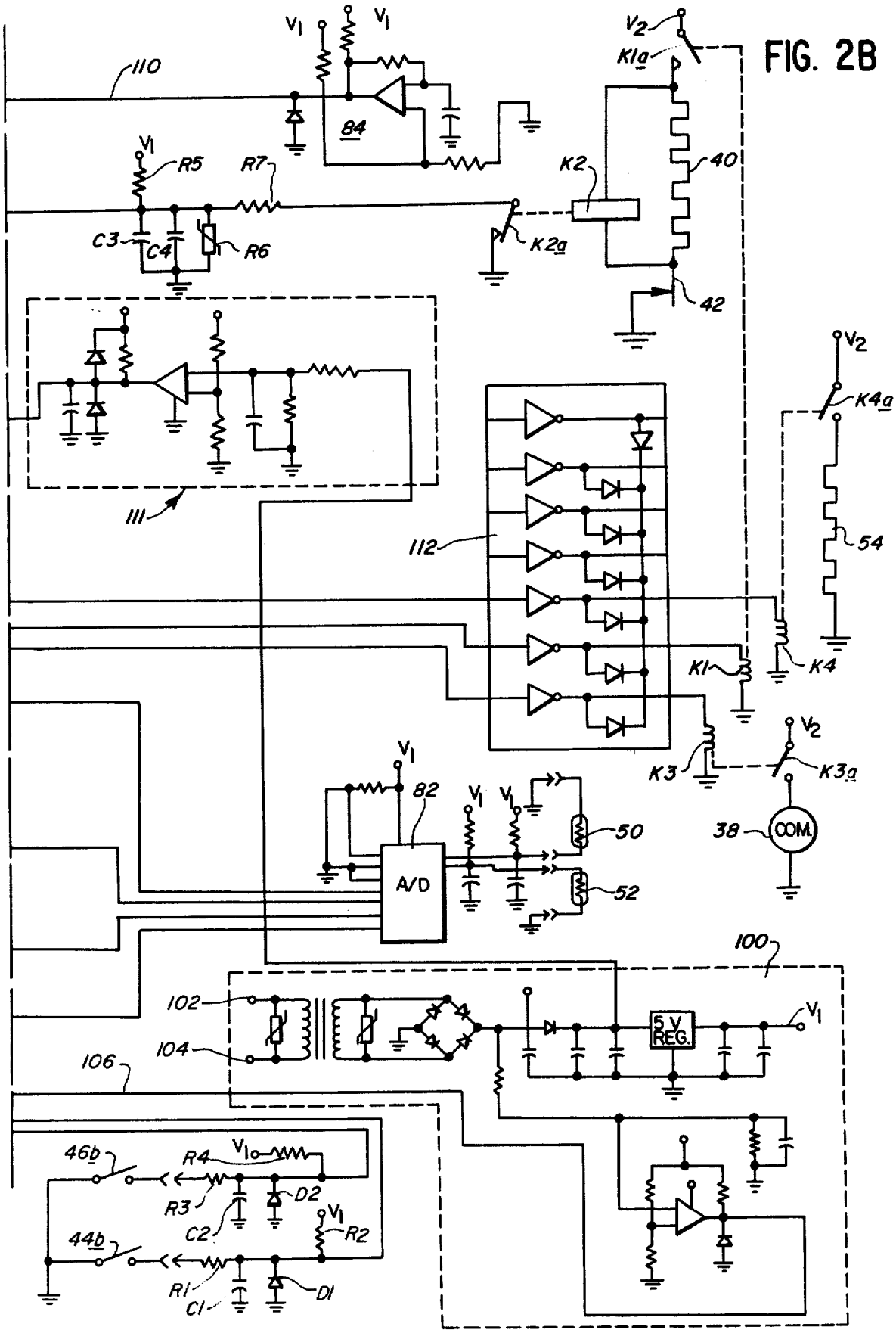

Referring now to FIGS. 2A and 2B, the circuit of the adaptive defrost control system shown in block form in FIG. 1 is illustrated in detail. Two power supply inputs VCC and GRD for the microcomputer 58, FIG. 2A, are connected to a source of DC potential V1 and ground potential, respectively. The voltage V1 is developed by an AC to DC converter and regulator 100, shown in FIG. 2B, which receives AC line current over a pair of terminals 102,104. A second output from the AC to DC converter 100 is developed on a line 106 and is coupled to an input IN0 of the microcomputer 58.

The signal on the line 106 is a 60 hertz square wave signal which provides a time base for the seconds and minute timers 68 and 69, shown in FIG. 1.

A clock input CKI of the microcomputer 58 receives a 200 kilohertz signal from the clock circuit 84, seen in FIGS. 1 and 2B, over a line 110. The signal from the clock circuit 84 establishes the time base for program execution performed by the microcomputer 58.

A power-on reset circuit, or POR 111 provides a reset signal to an input $\overline{\text{RESET}}$ of the microcomputer 58 for a short time period following the application of power thereto to prevent an erroneous energization of outputs thereof during the startup procedure. Circuit 111 also shuts off the microcomputer when the DC input voltage falls below a predetermined level.

The door-open information is coupled to the microcomputer 58 over two input lines IN1 and IN2, FIG. 2A. A contact 44*b* of the freezer door switch, FIG. 2B, is connected to the input IN1 through a resistor R1 and to supply potential V1 through a resistor R2. Similarly, a contact 46*b* of the fresh food door switch 46 is connected to the input IN2 through a resistor R3 and to voltage supply V1 through a resistor R4. The opposite terminals of both switches are connected together and to ground potential. A capacitor C1 and diode D1 are connected between the input IN1 and ground. Likewise, a capacitor C2 and a diode D2 are connected between the input IN2 and ground.

The determination of whether a door 30,32 is open is made by analyzing the signals present at the inputs IN1 and IN2. For example, if the freezer door 30 is open, then the switch contact 44*b* will be closed, thereby coupling a low state signal to the input IN1. This signal in turn causes the freezer door timer 72, shown in FIG. 1, to begin timing the period of the door-open interval.

The circuitry connected to the input IN2 operates in an identical manner to start and stop actuation of the fresh food door timer 74, FIG. 1.

A data input CKO is coupled to circuitry which senses the energization of the defrost heater 40 and the opened-closed status of the bimetal sensor 42. When the microcomputer 58 determines that defrosting is required, a signal is generated at an output D1 which is coupled through a driver circuit 112 and which energizes a relay coil K1. A set of relay contacts K1*a* are closed by the energized relay coil K1, thereby coupling a source of potential V2 across the defrost heater 40 and the bimetal sensor 42. At this time, the bimetal sensor 42 is closed, energizing the defrost heater 40.

The relay K2 is coupled across the defrost heater 40 to sense the energization thereof. Energization of the coil K2 in turn opens relay contacts K2*a* and allows a high state signal to be coupled from the voltage source V1 through a resistor R5 to the input CKO. Transient protection is afforded by a pair of capacitors C3,C4 and a voltage-variable resistor R6. A resistor R7 limits the current flowing from the voltage source V1 to ground when the relay contacts K2*a* are closed.

Additional inputs to the microcomputer 58 are provided at a series of inputs S0, SI, G0 and SK from the analog to digital converter 82. The A to D converter, in turn, receives as inputs the freezer and fresh food compartment thermistors 50,52, respectively.

The A-D converter senses the voltage across the thermistors 50,52 and provides a digital output indicating the temperatures to which these thermistors are exposed.

An output D0 of the microcomputer 58 is utilized to control the compressor 38 via the relay coil K3 and through the driver circuit 112. The energization of the relay coil K3 by the output D0 closes the associated contacts K3*a*, in turn actuating the compressor 38.

If it is desired to control the mullion heater 54 with the microcomputer 58, then an output D2 is utilized. When a high state signal is generated at the D2 output, a relay coil K4 is energized via the driver circuit 112 thereby closing the relay contacts K4*a*. The mullion heater is then connected across a voltage source V2, in turn energizing the heater 54.

Referring specifically to FIG. 2A, the registers 66 within the RAM 62 store various intermediate and final results during execution of the control program. These registers, designated FT, ODL, CORR, W, TBND, MINDT, MAXDT and HF are utilized in a manner to be hereinafter described in detail. The RAM 62 also contains a door-open counter 220 and a freezer temperature timer 196 which are utilized as noted below.

A series of registers are contained within the ROM 60 and are designated MAXDEF, DESDEF, MAXW, MINW and HMAX. These registers contain constants used during the control program. In the preferred embodiment, the contents of these registers are as follows:

| REGISTER | CONTENTS |
|---|---|
| MAXDEF | 1260 seconds |
| DESDEF | 960 seconds |
| MAXW | 360 seconds |
| MINW | 60 seconds |
| HMAX | 33 |

Figure 4:
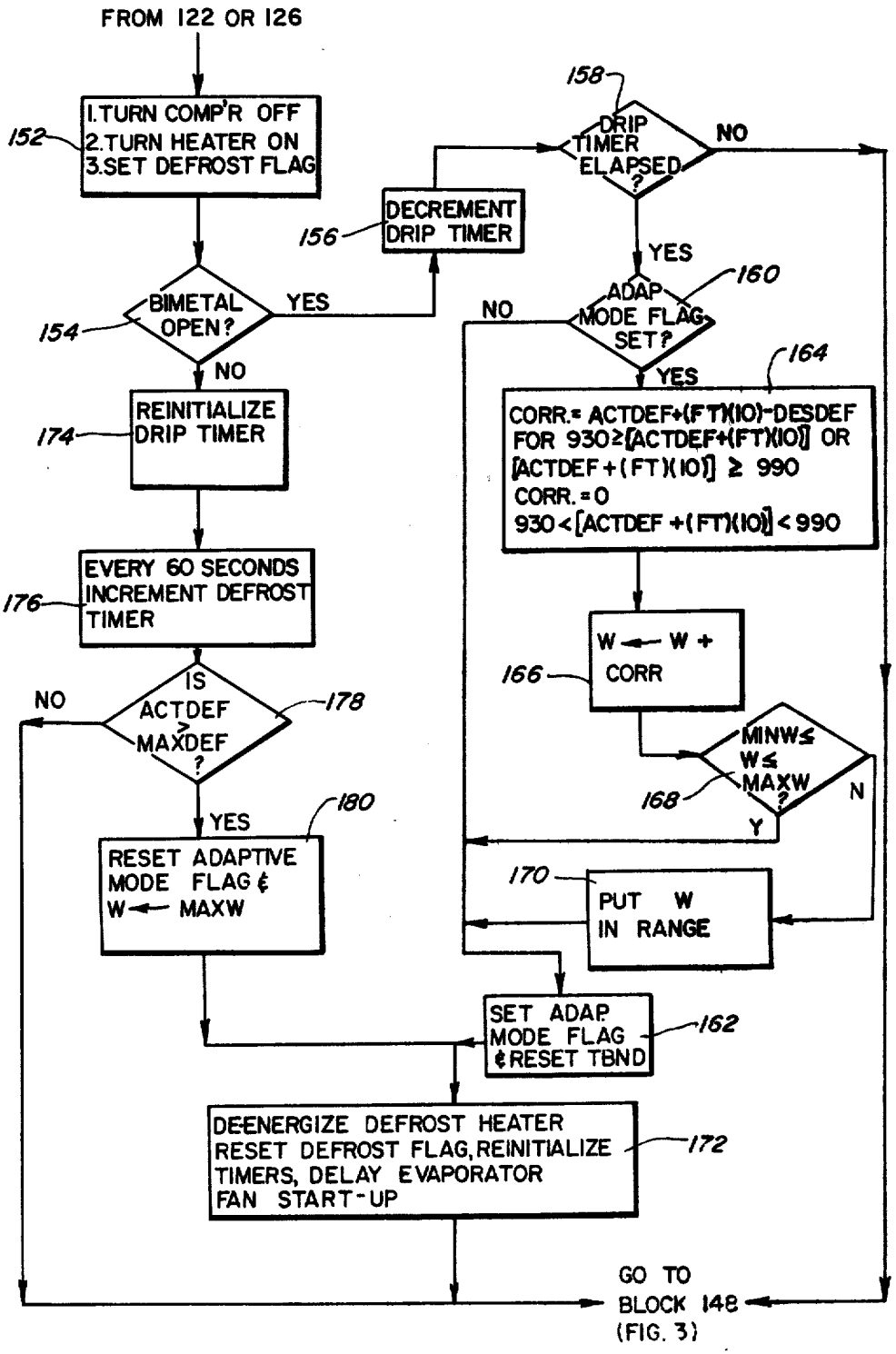

Referring also to FIGS. 3 and 4, the control program of the adaptive defrost control system will be described. The program cycle is executed once each second to continuously update the system condition. Moreover, during each program cycle, the seconds timer 68 is incremented.

As seen in FIG. 3, following energization of the various components used in the control, a block 120 initializes the variables used in the control program. The defrost flag register 80 and the adaptive mode flag register 81 shown in FIG. 1 are both reset. The register FT, which stores the freezer compartment temperature sensed by thermistor 50, is initialized to zero.

The register W which stores the decrementing factor is assigned a value of 210, which is midway between its lower limit stored in the MINW register, and its upper limit stored in the MAXW register.

The register CORR, which stores the correction factor, the freezer and fresh food door timers 72,74, the defrost timer 76 and the seconds timer 68 are all assigned a value of zero.

The register TBND, which stores the time before next defrost, is assigned a value of 518,400, which must be decremented to zero before a defrost operation is initiated. The compressor run timer 70 is assigned a value of 360 minutes (6 hours) of compressor operation before a defrost operation may be initiated. The minute timer 69 is assigned a value of 60.

Following the initialization performed in block 120, a decision block 122 determines whether the defrost heater 40 is energized by analyzing the signal appearing at the CKO input of the microcomputer 58, FIG. 2A. If the defrost heater 40 is energized, then control passes to a block 152, FIG. 4, which is the first step of the defrost routine, to be described in greater detail below.

If the block 122 determines that the defrost heater 40 is not energized, then a decision block 124 determines whether the control is in the adaptive mode. This is performed by determining whether the adaptive mode flag register 81 is set. If it is determined that the control is not in the adaptive mode, then control passes to a block 126 which determines whether the compressor has accumulated 6 hours of run time by checking the contents of the compressor run timer 70. It should be noted that the compressor run timer 70 is decremented by one count at the end of each minute of compressor operation, as indicated by the compressor minute timer 69, which is operative only when the compressor 38 is energized. If the decision block 126 determines that the compressor has accumulated 6 hours of run time then control passes to the block 152 to initiate the defrost sequence.

If the decision block 124 determines that the control is in the adaptive mode, then a decision block 128 determines whether the compressor minute timer 69 has elapsed. If the timer 69 has elapsed, then the timer 69 is reset and the compressor run timer is decremented by one and the register TBND is decremented by sixty.

A decision block 132 then determines whether the contents of the register TBND have been decremented to zero. If it has not, or if the block 128 determines that the compressor minute timer has not elapsed, then control passes to a block 134 which determines whether the fresh food door 32 is open. This is determined by analyzing the input IN2 of the microcomputer 58, FIG. 2A, and determining whether a high state signal is present thereon. If the block 132 determines the count TBND has been decremented to zero, then control passes to the block 126.

If the block 134 determines that the fresh food door 32 is open, then the count TBND is decremented by a block 136 by an amount depending on the contents of the fresh food door timer 74, shown in FIG. 1. If the door 32 has been open for less than five seconds, then the count TBND is decremented according to the weighting schedule as represented by the following equation:

$$TBND = TBND - (16\,(\tfrac{1}{2})^{t-1})\ W \text{ for } 0 < t \leqq 5$$

where t equals the time in full seconds that the door 32 has been open.

If the door 32 has been open for longer than five seconds, then the count TBND is decremented by the current value of W.

A block 138 follows the block 136 and determines whether the count TBND has been decremented to zero. If it has, then control passes to the block 126.

If the count TBND has not been decremented to zero, then a block 140 determines whether the freezer door 30 is open by sensing whether a high state signal is present on the input IN1. If the door is open, then count TBND is decremented according to the weighting schedule represented by the following formula:

$$TBND = TBND - 5(W)$$

A block 144 then determines whether the count TBND has been decremented to zero, and if it has, then control passes to the block 126. On the other hand, if the count TBND has not been decremented to zero, then a block 146 sets the adaptive mode flag, indicating that the defrost control is in the adaptive mode. Control then passes to a block 148 comprising a temperature control routine.

The temperature control routine is utilized to control the temperatures within the freezer compartment 26 and fresh food compartment 28. Generally, the routine senses the values of the thermistors 50,52 and compares the temperatures indicated thereby against user-selected set points. If the fresh food or freezer compartment temperatures exceed a range of temperatures surrounding the set points, then the compressor 38 is energized or de-energized to bring the compartment temperatures within the range of temperatures.

Control from the temperature control routine performed by block 148 then passes back to the decision block 122.

If, whenever control is passed to decision block 126, it is determined that the compressor has not run for six hours, then a block 150 resets the adaptive mode flag, thereby removing the defrost control from the adaptive mode. This is desirable since the adaptive control has called for a defrost operation following an interval which is shorter than the minimum compressor run time due to an abnormal condition, such as a large number and/or duration of door openings. Therefore, the control prevents the next defrost interval from being adaptively varied in response to the abnormal condition, As shown, control then passes from block 150 to block 148.

If the block 126 determines that the compressor 38 has run for six hours, then control passes to a block 152, FIG. 4, which initiates the defrost routine. The block 152 de-energizes the compressor 38 by providing a low state signal at the output D0 at the microcomputer 58, energizes the defrost heater 40 by energizing the output D1 of the microcomputer 58 and sets the defrost flag register 80, FIG. 1, indicating that defrost is occurring.

A decision block 154 then determines whether the bimetal sensor 42 is open by analyzing the input CK0 to the microcomputer 58. If a low state signal is coupled to the input CKO, indicating that the bimetal 42 has opened, then the contents of the drip timer 78, FIG. 1, are decremented by one, and control passes to a decision block 158.

It should be noted that the drip timer 78, initialized to 30 seconds by the block 120, FIG. 3, is utilized to prevent re-energization of the compressor 38 for a 30 second period of time following a defrost operation to allow water to drip off the evaporator coils 34 to prevent re-icing thereof.

The decision block 158 then determines whether the drip timer 78 has elapsed. If it has not, then control passes back to the temperature control routine performed by the block 148, FIG. 3.

If the drip timer 78 has elapsed, then a block 160 determines whether the control is in the adaptive mode by checking the contents of the adaptive flag register 81. If this register is not set, indicating that the control is not in the adaptive mode, then control passes to a block 162, which sets the adaptive mode flag and re-initializes the count TBND to its original value. The next defrost operation will then take place once the count TBND has been decremented to zero unless the compressor timer 70 has not elapsed, as described above in connection with FIG. 3.

If the block 160 determines that adaptive mode flag has been set, then control passes to a block 164 which calculates the value stored in the CORR register shown in FIG. 2A. The value stored in this register is calculated as follows:

$$CORR=[ACTDEF+(FT)(10)]-DESDEF$$

$$CORR=0 \text{ if: } 930<[ACTDEF+(FT)(10)]<990$$

where ACTDEF is the actual defrost length measured by the defrost timer 76, DESDEF is a constant representing the desired or optimum defrost length and stored in the ROM 60, FIG. 2A, FT is the freezer temperature (in degrees Fahrenheit) measured during the temperature control routine performed by block 148.

As seen by the above equations, the actual defrost length, measured by the control and stored in the register ACTDEF, is corrected as a function of the freezer temperature occurring during the temperature control routine. This temperature is multiplied by 10 for scaling purposes.

It should also be noted that if the corrected defrost time, represented by the summation of the actual defrost time and the freezer temperature multiplied by 10, is within a particular range of time, such as between a lower limit of 15.5 minutes (i.e. 930 seconds), and an upper limit of 16.5 minutes (i.e. 990 seconds), then the value stored in the CORR register is set equal to zero. This feature is included in the defrost control technique to account for the manufacturing tolerances of the bimetal sensor 42, which may have a switching point up to 3°–4° F. on either side of its nominal rating. Consequently, a defrost length within this range of time is considered to be of optimal duration and, hence, no correction is required.

The following chart illustrates the manner in which the defrost operation duration ACTDEF is corrected in response to changes in the measured freezer temperature prior to defrost. The following chart also illustrates the manner in which the correction factor CORR for the variable W varies in response to the corrected defrost operation duration.

| ACTDEF | FREEZER TEMP. | CORRECTED DEFROST LENGTH | CORR |
|---|---|---|---|
| 840 sec | 15 °F. | 990 sec | 30 |
| 840 | 10 | 940 | 0 |
| 840 | 5 | 890 | −70 |
| 840 | 0 | 840 | −120 |
| 840 | −5 | 790 | −170 |

Where corrected defrost length=ACTDEF+FT(10)

Following the block 164 is a block 166 which adds the value stored in the CORR register with the value stored in the W register and assigns this result to the W register.

A decision block 168 then determines whether the newly calculated value of W is between the upper and lower limits MINW and MAXW, respectively. As previously noted, the value MINW is equal to 60 and the value MAXW is equal to 360. If it is determined by the block 168 that the newly calculated value of W is between these limits, then control passes to the block 162. If W is not within this range, then a block 170 changes the value of W to put it within the range between MINW and MAXW. For example, if W is less than MINW, then the block 170 stores in the W register a value equal to MINW, and conversely, if the value of W is greater than MAXW, then the MAXW value is stored in the W register. Control from the block 170 then passes to the block 162.

Following the block 162 is a block 172 which de-energizes the defrost heater 40 by de-energizing the output D1 of the microcomputer 58. The block 172 also resets the defrost flag 80, reinitializes each of the timers 69, 70, 72, 74, 76 and 78, and delays the evaporator fan 36 reenergization for a short delay period. This is to insure that the evaporator 34 has been cooled somewhat following a defrost operation to prevent the reintroduction of warm air into the refrigerated compartments 26,28 when the evaporator fan 36 is energized.

If the block 154 senses a high state signal at the input CKO of the microcomputer 58, indicating that the bimetal sensor 42 is not open, then a block 174 reinitializes the drip timer 78 to 30 seconds. A block 176 then increments the defrost timer 76 by one minute when 60 seconds of defrost heater 40 operation have elapsed.

A block 178 then checks to determine whether the defrost operation duration ACTDEF stored in the defrost register 76 is greater than a maximum duration MAXDEF, stored in the ROM 60, FIG. 2A. As before noted, the value of MAXDEF is equal to 21 minutes. If the defrost operation duration has not exceeded this upper limit, the control passes to the block 148, FIG. 3, which cycles the refrigerator 20 through the temperature control routine.

If the block 178 determines that the defrost operation duration has exceeded the upper limit MAXDEF, then the defrost control is taken out of the adaptive mode by a block 180, and the register W, FIG. 2A, is assigned the value stored in the MAXW register in the ROM 60. This will result in the next defrost operation being initiated after six hours of accumulated compressor run time. By assigning the value MAXW to the W register, the control will, depending on the amount of usage the refrigerator receives, tend to initiate the next adaptive defrost operation after a relatively short defrost interval. This is desirable since the current defrost length duration has been exceedingly long, indicating a severe buildup of ice on the evaporator coils 34.

Control from the block 180 then passes to the block 172 and from there to the block 148 which performs the temperature control routine.

First Alternative Embodiment—Variable Optimum Defrost Length

Figure 5:
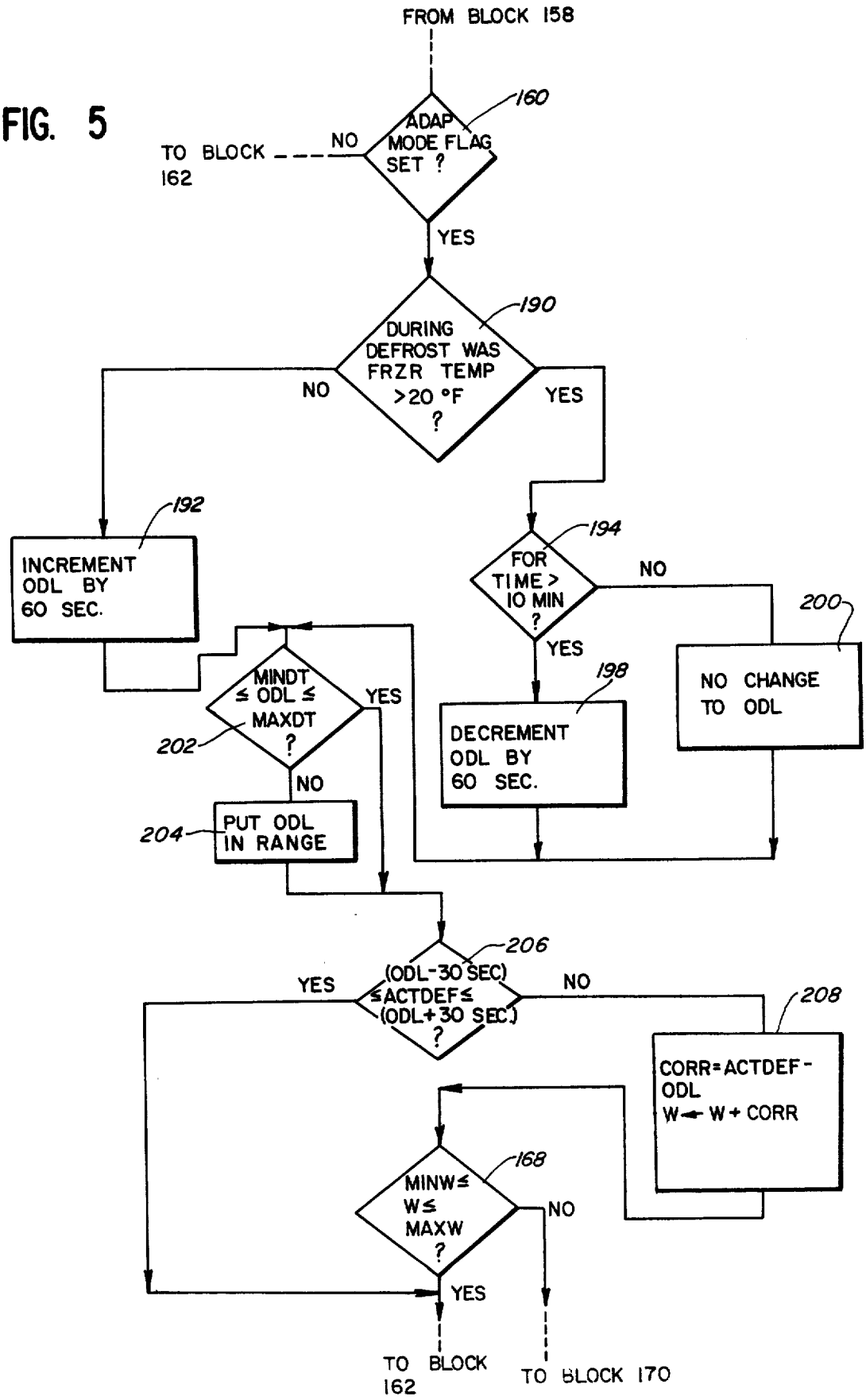
FIG. 5 is a flow chart of a program for implementing an alternative embodiment of the present invention.

Referring now to FIG. 5, there is illustrated a block diagram of a process which may be used in lieu of the blocks 164 and 166 shown in FIG. 4. The process shown in FIG. 5 is utilized to compare the actual defrost length against a variable optimum defrost length, designated ODL, as opposed to a fixed desired defrost time (DESDEF in the previous embodiment). The process shown in FIG. 5 utilizes two registers in the RAM 66, designated MINDT and MAXDT, representing the minimum desired defrost length and the maximum desired defrost length, respectively. The range between these two desired defrost lengths represents the range of possible values for the optimum defrost length ODL.

The registers MINDT and MAXDT are initialized by the initialization block 120, FIG. 3, immediately following energization of the system to predetermined desired values, such as 8 minutes and 20 minutes, respectively.

Following the block 160, FIG. 4, a block 190 determines whether the freezer temperature was greater than 20° F. during the previous defrost operation. This is performed by analyzing the contents of the register FT, FIG. 2A, which stores periodic readings of the freezer temperature during the defrost operation. If the freezer temperature was not above 20° F., then the optimum defrost length ODL is incremented by adding a small value, such as 60 seconds, to the contents of the register ODL, which will tend to increase the length of subsequent defrost operations.

If the block 190 determines that the freezer temperature was greater than 20° F., then a block 194 determines whether this temperature was exceeded for a time greater than 10 minutes. This is accomplished by analyzing the contents of the freezer temperature timer 196, FIG. 2A, which measures the length of time the freezer temperature exceeded 20° F.

If it is determined that the freezer temperature exceeded 20° F. for greater than 10 minutes, then the optimum defrost length ODL is decremented by subtracting from the contents of the register ODL a small amount such as 60 seconds. The decrementing of the optimum defrost length ODL in turn results in a tendency of a subsequent defrost length to become shorter, thereby limiting the rise of temperature within the freezer compartment 26.

If it is determined by the block 194 that the freezer temperature exceeded 20° F. for less than 10 minutes, then no change is made to the existing optimum defrost length ODL, and, hence, the contents of the register ODL remain unaffected.

Following the blocks 192, 198 or 200, is a decision block 202 which checks to determine whether the optimum defrost period ODP is within predetermined limits. This is accomplished by determining whether the contents of register ODL are greater than or equal to the contents of the MINDT register and less than or equal to the contents of the MAXDT register. It should be noted that the particular limits of eight minutes and 20 minutes for MINDT and MAXDT and the freezer temperature of 20° F. illustrated in this embodiment are exemplary only and other numbers may be substituted therefor.

If the block 202 determines that the optimum defrost length ODL is not within the range between MINDT and MAXDT, then block 204 puts the optimum defrost period within this range by either increasing or decreasing the contents of the ODL register to MINDT or MAXDT.

If it is determined that the optimum defrost length is within the range between MINDT and MAXDT, then control bypasses the block 204 and proceeds directly to a decision block 206.

The decision block 206 checks the contents of the register ACTDEF and determines whether the value stored therein is between the values stored in the register ODL±30 sec. The ±30 sec. defines a range of acceptable values surrounding the optimum defrost length ODL and is included to account for performance variations due to manufacturing tolerances, such as the tolerance for the bimetal sensor 42. If ACTDEF is within this range, then control passes directly to the block 162, FIG. 4.

If the block 206 determines that the value ACTDEF is not within ±30 sec. of the optimum defrost length, then a block 208 recalculates the value stored in the W register depending upon the value of ACTDEF. If the value ACTDEF is greater than the value stored in the ODL register, then the value of W is incremented by the amount that ACTDEF exceeds ODL. If ACTDEF is less than the value stored in the ODL register, then the value W is decremented by the amount that ACTDEF is less than ODL. In this way, if the actual defrost length was less than the minimum optimum defrost length value, ODL−30 sec., the recalculated value of W will tend to increase the next interval between defrost operations, and, hence, the next defrost length will tend to be increased. Conversely, the value of W will be incremented, and hence, the next defrost length will tend to be decreased if the actual defrost length was greater than the maximum optimum defrost length value, ODL+30 sec.

Following the block 208, the block 168 checks to determine whether W is between its minimum value MINW and its maximum value MAXW, as described in connection with FIG. 3. Control from the block 168 then proceeds to either block 162 or block 170 to continue the defrost control process.

It can thus be seen that this embodiment of the invention comprises a control technique in which the actual defrost length tends toward an optimum defrost length which can vary between predetermined limits in response to the temperature conditions existing within the freezing compartment during defrost operation. In the embodiment illustrated, the optimum defrost length and hence the actual defrost length will tend toward a value which does not allow the temperature within the freezing compartment to rise above 20° F. for more than 10 minutes. These temperature and time limits are employed to minimize the potential adverse effects of defrost operations on the food stored in the freezing compartment. Other temperature and time limits could be used, if desired.

Second Alternative Embodiment—Humidity Measurement Technique

Figure 6:
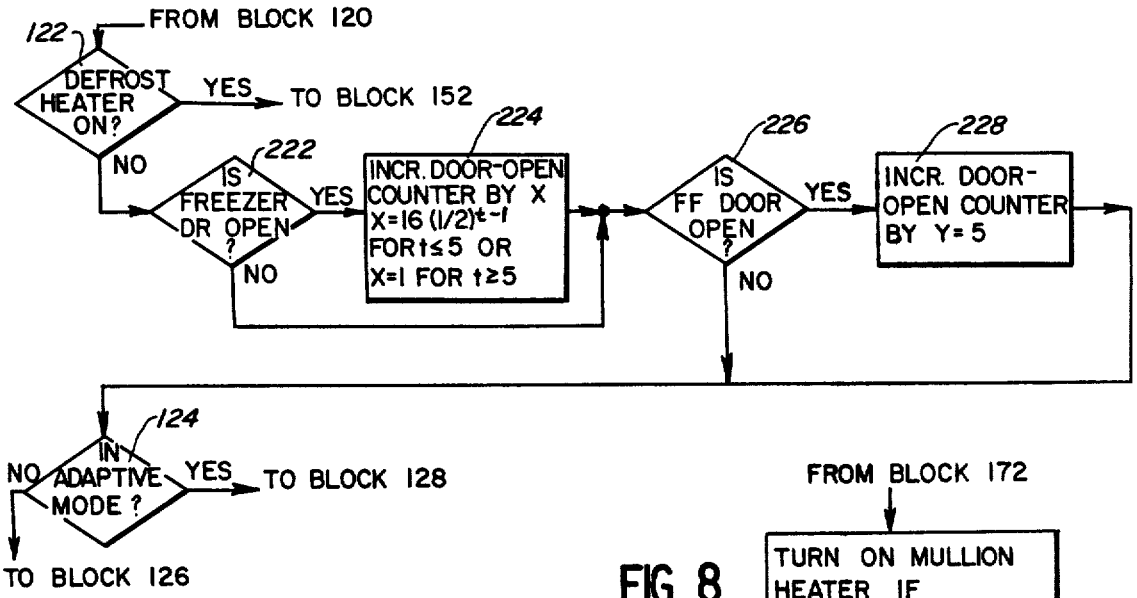
FIGS. 6, 7 and 8 are each portions of a flow chart for implementing a control of an anti-sweat heater for a refrigerator.
Figure 8:
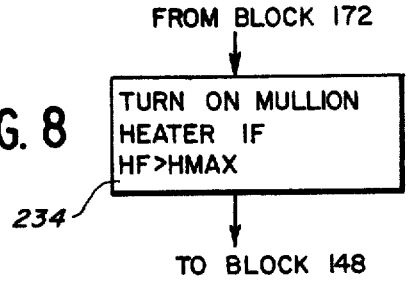
Figure 7:
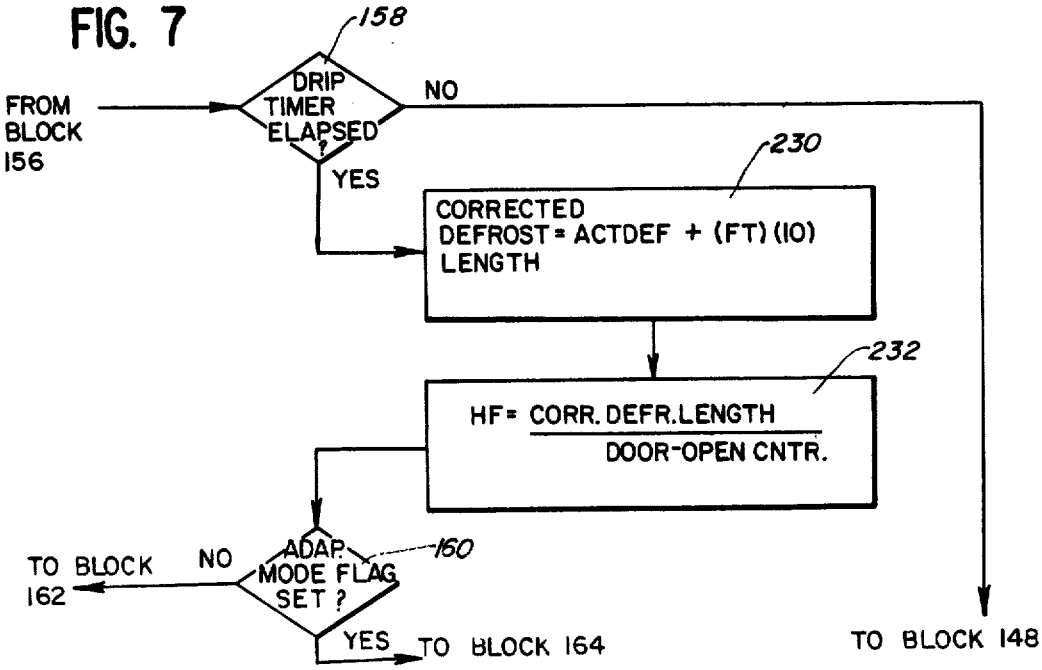

Referring now to FIGS. 6–8, there is illustrated a humidity measuring technique which may be utilized to develop a measure of the ambient humidity and control a humidity responsive device, such as the mullion heater 54, shown in FIGS. 1 and 2B. The subject matter shown in FIG. 6 is inserted, as shown, between the blocks 122 and 124 shown in FIG. 3, while the subject matter shown in FIG. 7 is inserted between the blocks 158 and 160 shown in FIG. 4, and the subject matter shown in FIG. 8 is inserted immediately following the block 172, FIG. 4.

The humidity measurement technique utilizes the register HF located within the RAM 66, the contents of which represent a value referred to as the humidity factor which is proportional to the humidity to which the refrigerator 20 is exposed.

It should be noted that, for this embodiment, the register HF and a door open counter 220 should both be initialized to zero by the block 120, FIG. 3 at the beginning of the control program.

Referring to FIG. 6, if the block 122 (FIG. 3) determines that the defrost heater 40 is not energized, then a decision block 222 analyzes the input IN1 of the microcomputer 58 to determine whether the freezer door 30 is open. If the door 30 is open, then a block 224 increments the door open counter 220 by an amount X, where:

$$X = 16(\tfrac{1}{2})^{t-1} \text{ for } 0 < t \leqq 5$$

or $X=1$ for $t>5$

If block 222 determines that the freezer door is not open, or following the calculation by the block 224, control passes to a block 226 which determines if the fresh food door 32 is open. If the door 32 is open, then the door open counter is incremented by a value Y, which is equal to 5.

It should be noted that the variables X and Y may have values other than those shown above based upon the amount of moisture that is normally caused to enter the refrigerator 20 whenever the freezer door 30 or the fresh food door 32 is opened.

Following the block 228, or if the block 226 determines that the fresh food door 32 is not open, control passes to the block 124 (FIG. 3) to continue the defrost control process. It should be noted that the door open counter 220 is incremented as shown in FIG. 6 once for each second that the freezer door or fresh food door is open.

Referring now to FIG. 7, if the block 158 determines that the drip timer 78 has elapsed, signalling the end of a defrost operation, then the corrected defrost length is calculated as follows:

$$\text{Corrected Defrost Length} = \text{ACTDEF} + (\text{FT})(10)$$

A block 232 then calculates the humidity factor HF by dividing the corrected defrost length by the contents of the door open counter 220. This result is stored in the HF register in the RAM 66.

To ensure that the number representing a measure of the ambient humidity is a whole number, it may be desirable to scale up the number representing the corrected defrost length before it is divided by the contents of the door open counter 220 to obtain the humidity factor HF. Alternatively, the reciprocal of the humidity factor can be calculated and stored in the HF register within RAM 66.

Control from the block 232 then passes to block 160 to resume the defrost control process.

Thus, the humidity factor HF is calculated only at the conclusion of a defrost operation and, since the corrected defrost length represents a measure of the amount of moisture which had accumulated on the evaporator during the last defrost interval and the contents of the door open counter represent a measure of the usage the refrigerator received during that interval, it can be appreciated that the above defined quotient represents a relative measure of the ambient humidity existing during the last defrost interval.

Referring now to FIG. 8, following the block 172 (FIG. 4) a block 234 compares the value stored in the register HF with a maximum humidity level stored in the register HMAX contained within the ROM 60. If the value of HF is greater than the value HMAX, then the mullion heater 54 is energized by generating a signal at the output D2 of the microcomputer 58 to warm the mullion area of the cabinet and thereby reduce condensation thereon.

The proper value for HMAX is best determined experimentally, and will vary depending on the type and size of the refrigeration apparatus involved. By way of example, in the illustrated embodiment HMAX may have a value of 33 where the number representing the corrected defrost length is multiplied by 100 (for scaling) before calculating the humidity factor HF in block 232.

Due to moisture leakage paths typically associated with the cabinet construction and door seals of a refrigerator, frost will gradually accumulate on the evaporator during periods when the refrigerator doors are being opened infrequently or not at all. Under such usage conditions the humidity factor HF calculated by block 232 will tend to be very large, regardless of the ambient humidity, because the contents of the door open counter will be extremely small. An erroneous indication of high ambient humidity can be prevented under such conditions by incorporating means for checking the contents of the door open counter 220 for some predetermined minimum amount of door opening time, and disregarding or disabling the humidity factor calculation of block 232 if the predetermined minimum time has not been accumulated.

It should be understood that other types of apparatus may be controlled by the above described humidity measuring technique, such as visual indicators, alarms or the like.

Having described the invention, the embodiments of the invention in which an exclusive property or privilege is claimed are defined as follows:

1. A method of initiating a defrost operation in a refrigerator at the end of a defrost interval, the refrigerator including a refrigerated compartment, an evaporator for cooling the compartment and defrosting means for removing frost from the evaporator during a defrost operation including means responsive to the temperature of the evaporator for terminating the defrost operation, the method comprising the steps of:

(a) developing a measure of the temperature of the evaporator during a defrost interval;

(b) initiating a defrost operation;

(c) measuring the duration of said defrost operation;

(d) correcting the measured duration of said defrost operation by an amount determined by said measured evaporator temperature to derive a corrected defrost duration; and (e) initiating a subsequent defrost operation at the end of a subsequent defrost interval that is determined in accordance with the corrected defrost duration.

2. The method of claim 1, wherein the step (a) includes the steps of:

sensing and storing the temperature of the refrigerated compartment during said defrost interval.

3. The method of claim 1, in which the refrigerated compartment is closed by an access door and wherein the step (e) includes the steps of:

(i) comparing the corrected defrost duration with a desired defrost duration to derive a correction factor;

(ii) establishing a count;

(iii) varying the count during the time the access door is open at a rate which is determined by the correction factor; and (iv) initiating the subsequent defrost operation when the count reaches a predetermined value.

4. The method of claim 3, wherein the step (e) further includes the step of establishing a weighting factor which determines the rate at which the count is varied and wherein the step of comparing includes the step of varying the weighting factor by the correction factor.

5. The method of claim 4, wherein the step of varying the count includes the step of decrementing the count according to a time dependent weighting schedule.

6. The method of claim 4, wherein the step of comparing includes the further step of setting the correction factor equal to zero when the corrected defrost duration is within a predetermined range of the desired defrost durations.

7. The method of claim 1, wherein the step of correcting the measured defrost duration comprises changing the measured defrost duration by an amount that is proportional to said measure of the evaporator temperature.

8. A method of defrosting a refrigeration apparatus at the end of a variable defrost interval, said apparatus having means defining a refrigerated compartment, an access door for the compartment, an evaporator for cooling the compartment and defrosting means for effecting the removal of frost from the evaporator, the method comprising the steps of:

(a) measuring the temperature within the refrigerated compartment during a defrost interval;
(b) energizing the defrosting means to initiate a defrost operation;
(c) measuring the length of time the defrosting means is energized during said defrost operation;
(d) storing a count;
(e) changing said stored count at a rate which is at least partly dependent upon said measured compartment temperature and said measured length of time the defrosting means is energized; and
(f) initiating a subsequent defrost operation at the end of an adaptively variable interval the length of which is dependent upon the changing of the stored count to a predetermined number.

9. A method of defrosting a refrigeration apparatus having means defining a compartment which is refrigerated to a below-freezing temperature, an access door for the compartment, an evaporator for cooling the compartment, electrically energizable defrosting means for removing frost from the evaporator, and means for terminating energization of the defrosting means when the evaporator reaches a predetermined temperature, the method comprising the steps of:

(a) measuring the temperature within said below-freezing compartment;
(b) initiating a defrost operation;
(c) measuring the length of said defrost operation to develop a defrost operation duration;
(d) changing the defrost operation duration by an amount which is dependent on said measured temperature to thereby obtain a corrected defrost duration which is proportional to the amount of frost removed from the evaporator during said defrost operation;
(e) comparing said corrected defrost duration with a desired defrost duration to develop a comparison value;
(f) developing a door weighting schedule that is a function of the comparison value;
(g) accumulating door-open time when the compartment door is open at a rate determined by the weighting schedule;
(h) initiating a subsequent defrost operation when a predetermined amount of door-open time has been accumulated; and
(i) repeating steps (a) through (h).

10. A method of defrosting a refrigeration apparatus at the end of a variable interval, the refrigeration apparatus having defrosting means, a cabinet defining a refrigerated space, and a door for providing access to said space, the method comprising the steps of:

(a) storing a signal having a first predetermined value;
(b) sensing when the door is open;
(c) changing the stored signal at a varying rate which decreases with time from an initial rate during a first door-open interval until a certain rate is reached;
(d) changing said stored signal at a fixed rate less than the certain rate for door-open times in excess of the first door-open interval; and
(e) initiating a defrost operation when the stored signal has been changed to a second predetermined value.

11. A method of defrosting a refrigeration apparatus at the end of a variable interval, the refrigeration apparatus having means defining a below-freezing compartment and an above-freezing compartment, an access door for the below-freezing compartment, an access door for the above-freezing compartment, an evaporator for cooling the compartments and defrosting means for removing frost from the evaporator, the method comprising the steps of:

(a) storing a count;
(b) sensing when either or both of the compartment doors are open;
(c) repeatedly changing the stored count by an amount that decreases with time during a first door-open interval of the above-freezing compartment door and repeatedly changing the stored count at a first fixed rate whenever said above-freezing compartment door remains open beyond the first door-open interval;
(d) repeatedly changing said stored count at a second fixed rate throughout the period of time the below-freezing compartment door is open; and
(e) initiating a defrost operation when the stored count reaches a predetermined value.

12. The method of claim 11, wherein the step (c) includes the steps of:

storing a weighting factor W; and
changing the stored count during the first door-open interval by an amount equal to $$16(\tfrac{1}{8})^{t-1}W$$

where t is the time in seconds that the above-freezing compartment door has been open.

13. The method of claim 11, wherein the step (c) includes the steps of:

storing a weighting factor W; and
changing the stored count by the weighting factor W for each second the above-freezing compartment door is open beyond the first interval.

14. A method of defrosting a refrigeration apparatus at the end of a variable interval, the refrigeration apparatus having means defining a below-freezing compartment and an above-freezing compartment, an access door for the below-freezing compartment, an access door for the above-freezing compartment, an evaporator for cooling the compartments and defrosting means for removing frost from the evaporator, the method comprising the steps of:

(a) storing a count;
(b) sensing when either or both of the compartment doors are open;
(c) repeatedly changing the stored count by an amount that decreases with time during a first door-open interval of the above-freezing compartment door and repeatedly changing the stored count at a first fixed rate whenever said above-freezing compartment door remains open beyond the first door-open interval, including the steps of storing a weighting factor W and changing the stored count during the first door-open interval by an amount equal to $$16(\tfrac{1}{8})^{t-1}W$$

where t is the time in seconds that the above-freezing compartment door has been open;

(d) repeatedly changing said stored count at a second fixed rate whenever the below-freezing compartment door is open;

(e) initiating a defrost operation when the stored count reaches a predetermined value;

(f) sensing the temperature of the below-freezing compartment prior to the initiation of the defrost operation;

(g) measuring the duration of the defrost operation;

(h) correcting the measured defrost duration by an amount dependent upon the sensed below-freezing compartment temperature; and (i) varying the weighting factor W in accordance with the corrected defrost duration.

15. The method of claim 14, wherein the step of correcting the defrost duration includes the steps of adding an integer multiple of the sensed below-freezing compartment temperature to the measured defrost duration to derive the corrected defrost duration.

16. The method of claim 15, wherein the step of correcting further includes the step of subtracting a desired defrost duration from the corrected defrost duration to derive a correction factor.

17. The method of claim 16, wherein the step of varying the weighting factor W includes the step of adding the correction factor to the weighting factor W.

18. A method of defrosting a refrigeration apparatus at the end of a variable interval, the refrigeration apparatus having means defining a below-freezing compartment and an above-freezing compartment, an access door for the below-freezing compartment, an access door for the above-freezing compartment, an evaporator for cooling the compartments and defrosting means for removing frost from the evaporator, the method comprising the steps of:

(a) storing a count;

(b) sensing when either or both of the compartment doors are open;

(c) repeatedly changing the stored count by an amount that decreases with time during a first door-open interval of the above-freezing compartment door and repeatedly changing the stored count at a first fixed rate whenever said above-freezing compartment door remains open beyond the first door-open interval, including the steps of storing a weighting factor W and changing the stored count by the weighting factor W for each second the above-freezing compartment door is open beyond the first interval;

(d) repeatedly changing said stored count at a second fixed rate whenever the below-freezing compartment door is open;

(e) initiating a defrost operation when the stored count reaches a predetermined value;

(f) sensing the temperature of the below-freezing compartment prior to the initiation of the defrost operation;

(g) measuring the duration of the defrost operation;

(h) correcting the measured defrost duration by an amount dependent upon the sensed below-freezing compartment temperature; and (i) varying the weighting factor W in accordance with the corrected defrost duration.

* * * * *